US006370985B1

(12) United States Patent
Wu

(10) Patent No.: US 6,370,985 B1
(45) Date of Patent: Apr. 16, 2002

(54) EXTRACTOR TOOL FOR PIPE COUPLING

(76) Inventor: Pi-Liang Wu, P.O. Box 55-175, Taichung (TW)

( * ) Notice: Subject to any disclaimer, the term of this patent is extended or adjusted under 35 U.S.C. 154(b) by 0 days.

(21) Appl. No.: 09/664,374

(22) Filed: Sep. 18, 2000

(51) Int. Cl.[7] ..... B25B 27/10

(52) U.S. Cl. ..... 81/9.3; 81/324; 29/229; 29/243.56; 29/237

(58) Field of Search ..... 81/9.3, 324, 320, 81/322, 328, 338; 29/229, 243.56, 237

(56) References Cited

U.S. PATENT DOCUMENTS 6,164,162 A * 12/2000 Furundzic ..... 81/9.3
6,276,236 B1 * 8/2001 Wu ..... 81/9.3

* cited by examiner

*Primary Examiner*—Robert C. Watson

(57) ABSTRACT

An extractor tool for coupling fastened to pipes comprises an actuation device, a holding device, and a cable having one end secured to the holding device and the other end slidably secured to the actuation device. In use, engage the holding device with the coupling and pivot the first actuation device to enlarge the diameter of the coupling, thereby detaching the coupling from the pipes through the cable.

5 Claims, 8 Drawing Sheets

EXTRACTOR TOOL FOR PIPE COUPLING

FIELD OF THE INVENTION

The present invention relates to an extractor tool for pipe coupling with improved characteristics.

BACKGROUND OF THE INVENTION

Various fittings (e.g., tee and elbow) have been used in linking the ends of pipes. Conventionally, a metal coupling 1 is fastened between the fitting and the pipe as shown in FIG. 1. Coupling 1 is generally of ring-shaped having an opening 101 on the cylindrical surface, a first tab 102 projected above the opening 101, and a second tab 103 projected from one side of opening 101. In operation, pull tabs 102, 103 away from each other to fasten coupling 1 after coupling 1 is put on the joint of pipes. To the contrary, use fingers or pliers to grip tabs 102, 103 toward each other to enlarge the diameter of coupling 1. Thereafter, unfasten coupling 1 to finish the disassembly.

In the case of narrow space where coupling 1 located such as engine of motor vehicle, it is not possible to use fingers or pliers to detach coupling 1. As such, special tool (i.e., extractor tool) is necessary. Such extractor tool is connected to a gripping device through a connecting cable. User may manipulate the cable to actuate the gripping device for detaching the coupling in the narrow environment.

But this is unsatisfactory for the purpose for which the invention is concerned for the following reasons:

1. Cable and gripping device are fixedly connected together. Thus only a single operation is available. This is not sufficient for the practical plumbing operation which usually requires other jobs in addition to the detaching of pipes. As such, user has to prepare other tools in performing the plumbing operation. This is not convenient.

2. The side of gripping device facing the object may not be correct. As such, user has to turn cable for aligning. This may twist cable and fail to smoothly manipulate the gripping device.

SUMMARY OF THE INVENTION

It is an object of the present invention to provide an extractor tool for pipe coupling for fastening a first pipe to a second pipe, the pipe coupling having a first and a second tab, the tool comprising:

an actuation device including a first handle having a first gripping portion at one end, a first attachment portion at the other end, and a first disk member between the first gripping portion and the first attachment portion, a second handle having a second gripping portion at one end, a second attachment portion at the other end, and a second disk member between the second gripping portion and the second attachment portion, a first pin pivotably secured the first and the second disk members together, an eye at the end of each of the first and the second attachment portions, a ratchet wheel on the arc of the first disk member, an abutment mechanism including an trigger member at one end and a pawl at the other end caught and held by the ratchet wheel for only allowing the first handle to move in one direction, a second pin inserted through the abutment mechanism and the first attachment portion, and a spring member between the second pin and the abutment mechanism for securing the second pin, the abutment mechanism, and first attachment portion together, thereby engaging the pawl with the ratchet wheel;

a holding device including a body having a wall in one end, an elongate recess open to the other end, a first opening at the wall, a second opening at the wall being larger than the first opening, and a channel communicating between the first and the second openings, a sliding member slidably provided thereon, a first pushing member projected downward from the body opposite to the wall, a recess, two opposite projections on the sides of the recess, an engagement member on either side of the sliding member, each projection being slidably sandwiched between the engagement member and the planar body of the sliding member, an upwardly projecting riser on one side of the sliding member opposite to the wall, and a downwardly projecting second pushing member under the sliding member opposite to the first pushing member, and a threaded hole on the riser; and a connecting cable device including a predetermined length of cable having an enlargement at one end smaller than both the threaded hole and the first opening and larger than the second opening so as to pass through the threaded hole and the first opening for engaging with the second opening and the other end slidably passed through the eye of the first attachment portion, a fastener for securing the cable to the eye of the second attachment portion, and a spring put on the cable between the wall and the riser, whereby engage the holding device with the coupling, pivot the first attachment portion away from the second attachment portion while gripping the first and the second gripping portions toward each other for pivoting the first disk member about the first pin to cause the ratchet wheel to turn relative to the pawl so as to pull the cable for adjusting the first and the second pushing members to cause them to tightly hold first and second tabs, grip the first and the second gripping portions to cause the first attachment portion to pivot away from the second attachment portion so as to tauten the cable, pull the enlargement and the wall toward the riser for sliding the sliding member relative to the body for compressing the spring so as to reduce the distance between the first and the second pushing members which in turn enlarges the diameter of the coupling, thereby detaching the pipes.

The above and other objects, features and advantages of the present invention will become apparent from the following detailed description taken with the accompanying drawings.

DETAILED DESCRIPTION OF THE PREFERRED EMBODIMENTS

Figure 1:
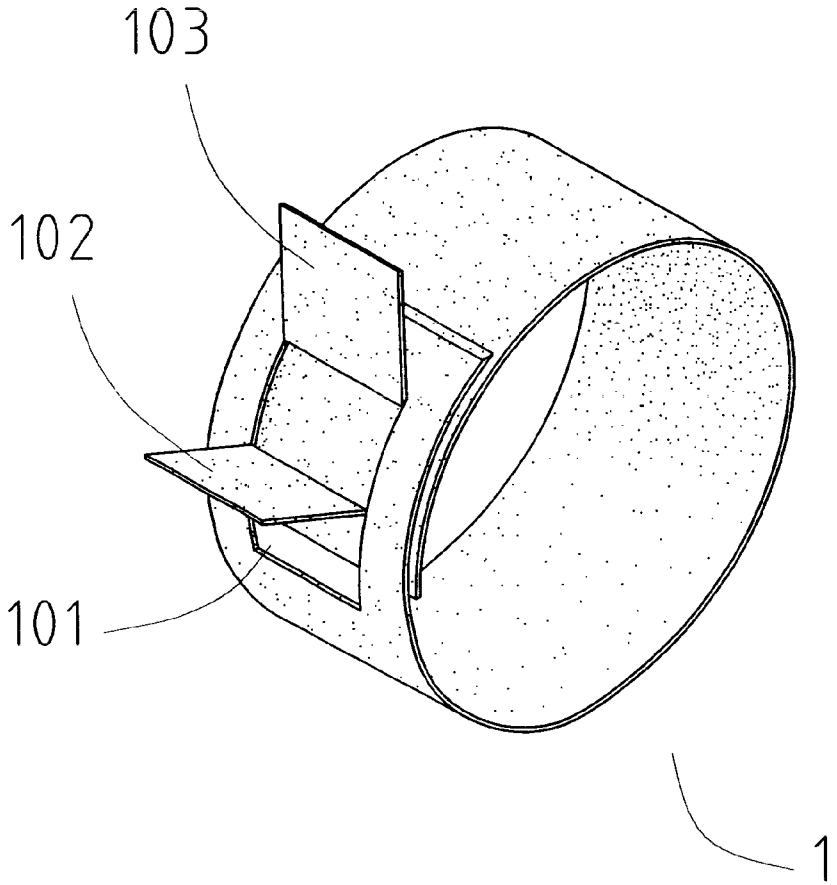
PRIOR ART FIG. 1
FIG. 1 is a perspective view of a conventional coupling.
Figure 2:
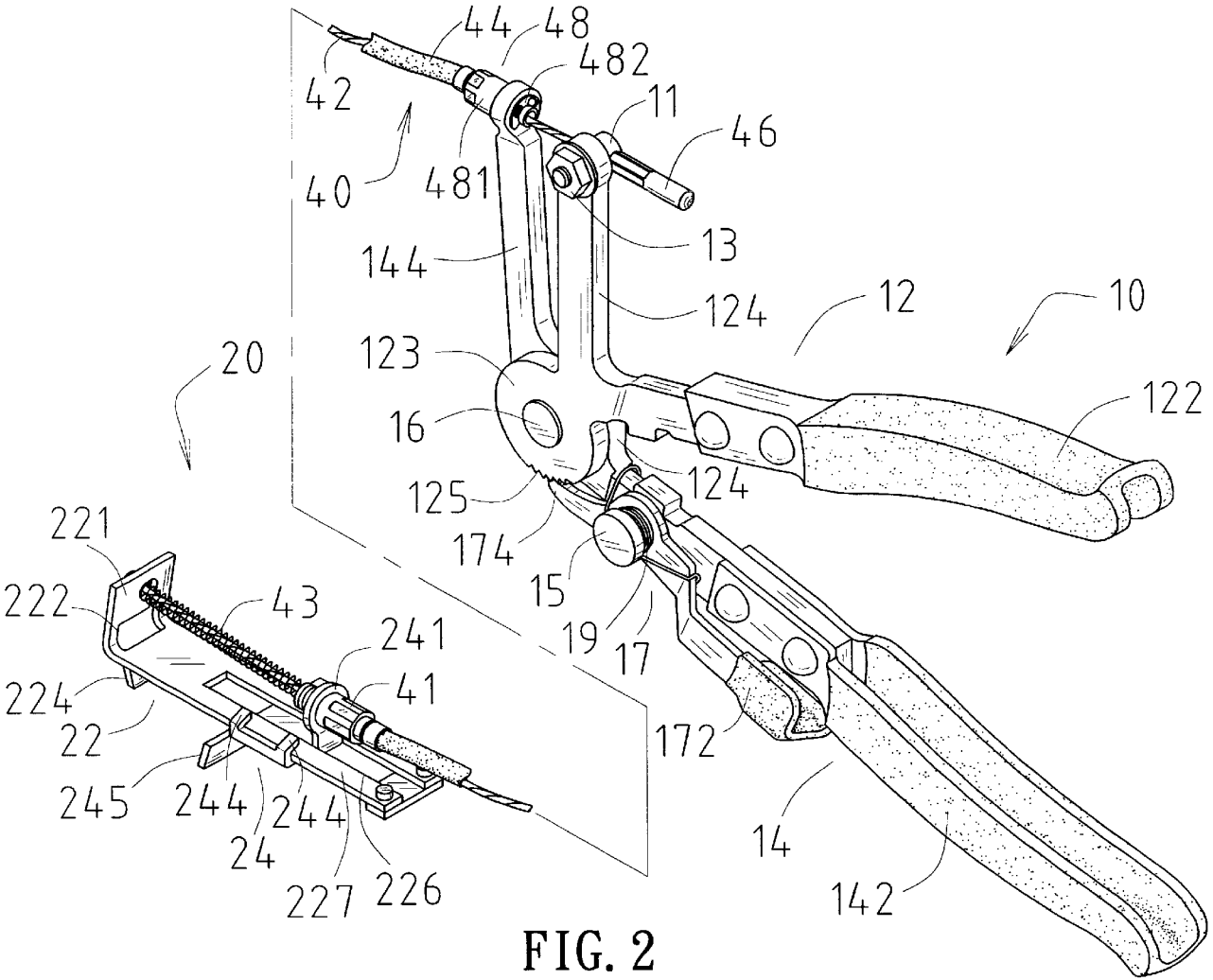
FIG. 2 is a perspective view of a first preferred embodiment of extractor tool according to the present invention.
Figure 3:
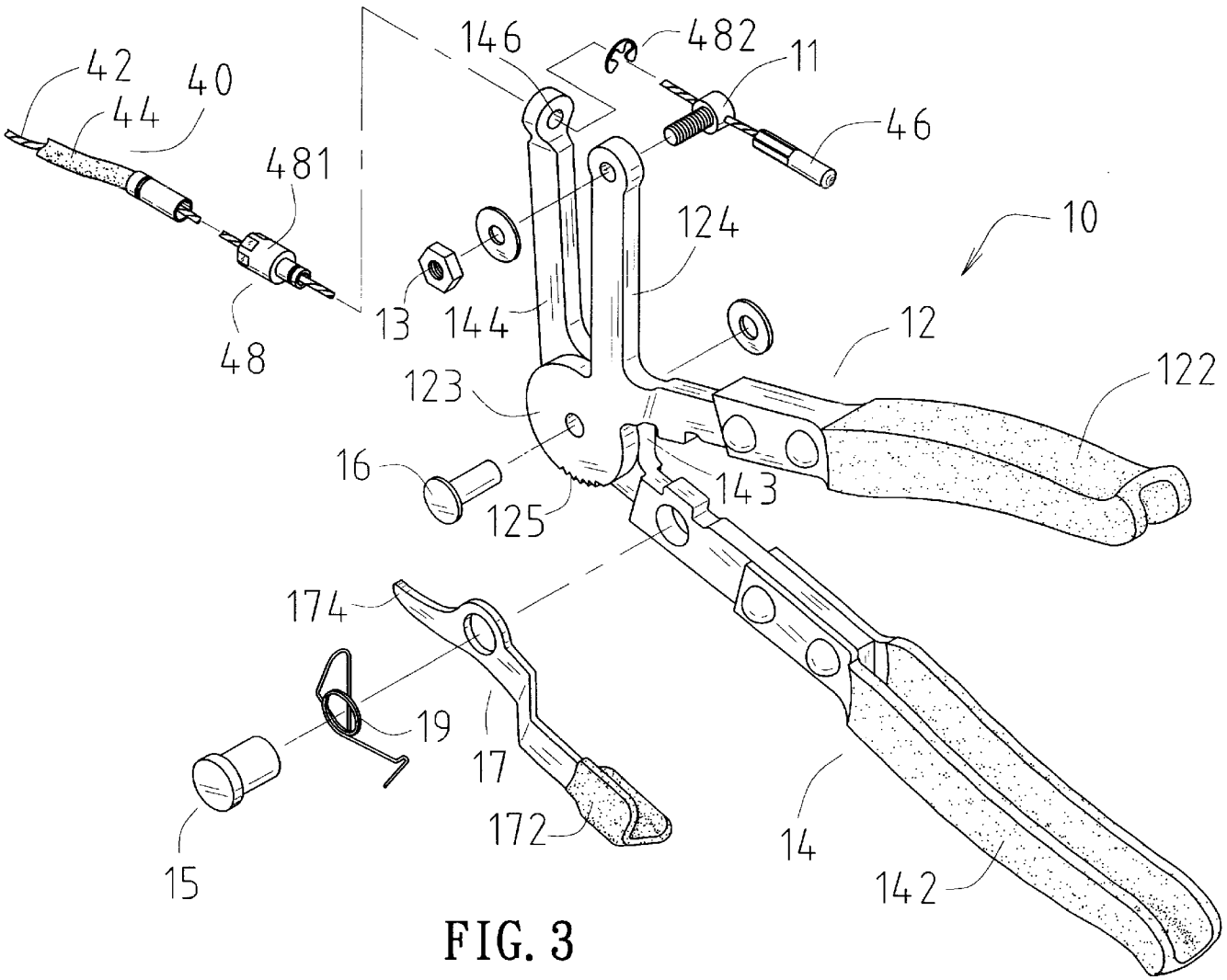
FIG. 3 is an exploded view of the FIG. 2 actuation device.

Referring to FIGS. 2 to 5, there is shown an extractor tool for pipe coupling constructed in accordance with the invention comprising an actuation device 10, a holding device 20, and a connecting cable device 40. As shown in FIG. 3, actuation device 10 comprises a first handle 12 having a first disk member 123, a second handle 14 having a second disk member 143, and a pin 16 pivotably secured disk members 123, 143 together. One end of first handle 12 is formed as first gripping portion 122 and the other end is formed as first attachment portion 124. Similarly, one end of second handle 14 is formed as second gripping portion 142 and the other end is formed as second attachment portion 144. An eye 146 is formed on the end of second attachment portion 144. Bolt 11 is threadedly secured to the end hole of first attachment portion 124 in cooperation with nut 13.

Connecting cable device 40 comprises a predetermined length of cable 42 and two pieces of shield 44 put on positions near the ends of cable 42. One end of cable 42 is connected to holding device 20, while the other end is passed through eye 146 and bolt 11 to form as head 46. As such, cable 42 may be tautened by actuating first attachment portion 124. A ratchet wheel 125 is formed on the arc of first disk member 123. An abutment mechanism 17 is secured to second gripping portion 142 by means of pin 15. Abutment mechanism 17 comprises an trigger member 172 on one end and a pawl 174 on the other end caught and held by ratchet wheel 125 for only allowing first handle 12 to move in one direction. A spring member 19 is engaged between pin 15 and abutment mechanism 17 having one end fastened to abutment mechanism 17 and the other end fastened to first attachment portion 142. This ensures that pawl 174 is always engaged with ratchet wheel 125.

A sleeving mechanism 48 is formed on one end of cable 42 having a sleeve 481 on one end inserted through eye 146 being slidably secured thereto by a clip 482.

Figure 4:
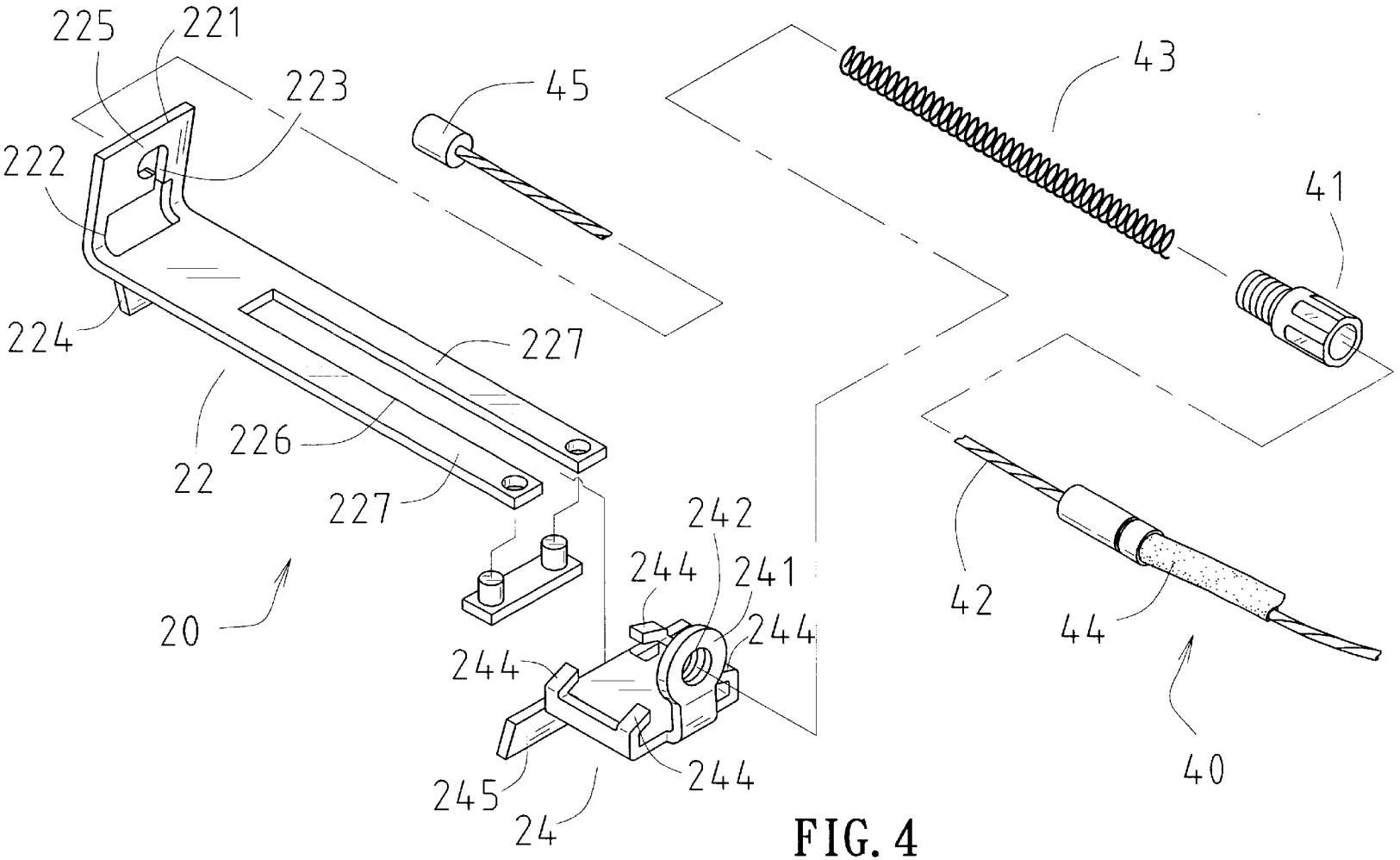
FIG. 4 is an exploded view of the FIG. 2 holding device.
Figure 5:
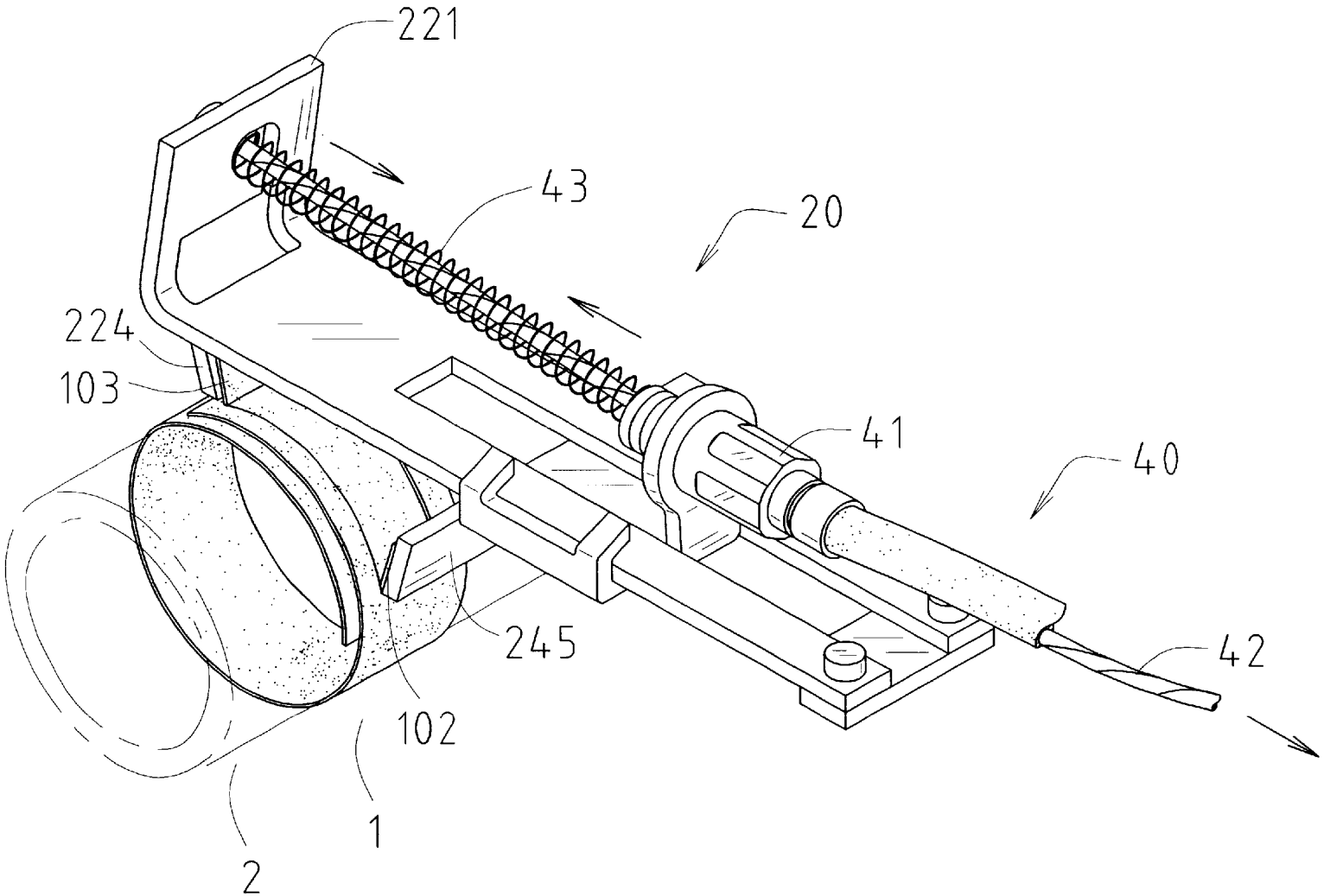
FIG. 5 is an operational view of the FIG. 4 holding device.

As shown in FIGS. 2 and 4, a connector 41 and a spring 43 are put on cable 42. Also, an enlargement 45 is formed at the end of cable 42. Holding device 20 comprises a body 22 and a sliding member 24 slidably provided thereon. Body 22 comprises a wall 221 in one end, an elongate recess 226 open to the other end, an opening 222 larger than enlargement 45 on the base of wall 221, an opening 225 smaller than enlargement 45 on the wall 221, and a channel 223 communicating between openings 222 and 225 such that enlargement 45 at the end of cable 42 may be secured at the opening 225. Spring 43 is biased between the wall 221 and connector 41.

A first pushing member 224 is projected downwardly from body 22 opposite to wall 221. Two opposite projections 227 are formed on the sides of recess 226. A bent inwardly engagement member 244 is formed on respective one of four corners of sliding member 24. Each projection 227 is slidably sandwiched between two engagement members 244 and the planar body of sliding member 24. An upwardly projecting riser 241 is formed on one side of sliding member 24 opposite to wall 221. A downwardly projecting second pushing member 245 is formed under sliding member 24 opposite to first pushing member 224. A threaded eye 242 is formed on riser 241 having a diameter larger than that of enlargement 45 so as to allow cable 42 to pass through. Also, connector 41 is threadedly secured to eye 242 such that two pieces of shield 44 may be pivotably secured to sliding member 24.

During use of the invention for detaching coupling i from pipe 2, first assemble holding device 20 and cable 42. Then smoothly pull connecting cable device 40 relative to actuation device 10. Next engage holding device 20 with coupling 1 and adjust first and second pushing members 224 and 245 to cause them to tightly hold first and second tabs 102 and 103. Then grip gripping portions 122, 142 to cause attachment portion 124 to pivot away from attachment portion 144 so as to tauten cable 42. And in turn enlargement 45 (as well as wall 221) are pulled toward connector 41. As such, sliding member 24 is slid relative to body 22 for compressing spring 43. This causes the distance between first and second pushing members 224 and 245 to be reduced which in turn enlarges the diameter of coupling 1, thereby loosening pipe 1.

Note that as stated above when attachment portion 124 pivots away from attachment portion 144 while gripping the gripping portions 122, 142 the disk member 123 is also pivoted about pin 16. As such, ratchet wheel 125 is turned relative to pawl 174. The engaged position of pawl 174 relative to ratchet wheel 125 is still maintained once the gripping force exerted on gripping portions 122, 142 is released due to the nature of ratchet wheel and pawl 174. This means that first and second pushing members 224, 245 always hold first and second tabs 102, 103.

Lift trigger member 172 a sufficient distance to disengage pawl 174 from ratchet wheel 125 after coupling 1 is detached from pipe 2. At the same time, spring 43 is expanded to push wall 221 and connector 41 away from each other. As such, first and second pushing members 224, 245 are moved away from each other, thereby disengaging from first and second tabs 102, 103. As an end, holding device 20 is disengaged from coupling 1. At the same time, disk members 12, 14 are returned to their original positions because cable 42 is loosened.

Figure 6:
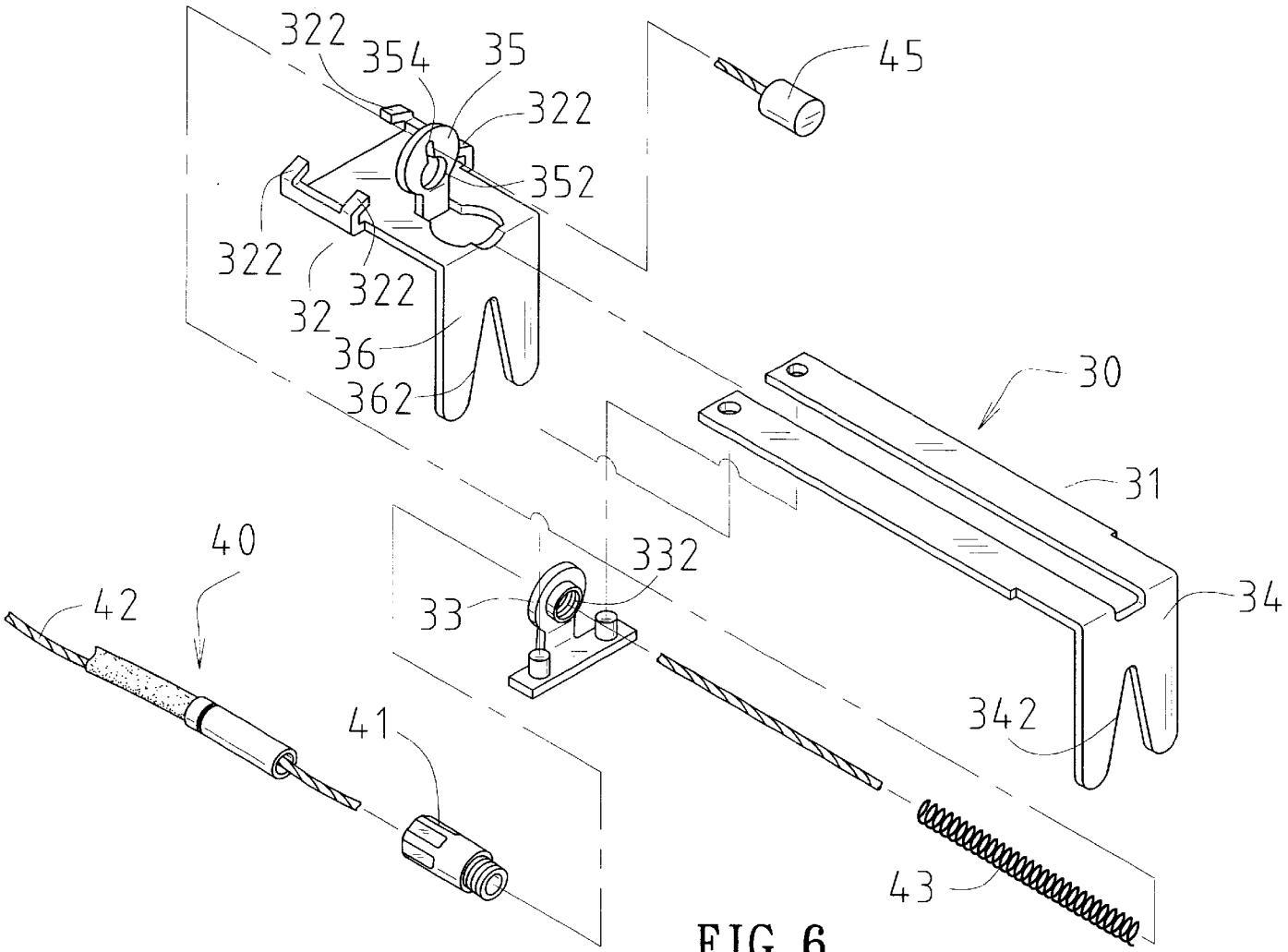
FIG. 6 is an exploded view of a clamping device of a second preferred embodiment of extractor tool according to the present invention.
Figure 7:
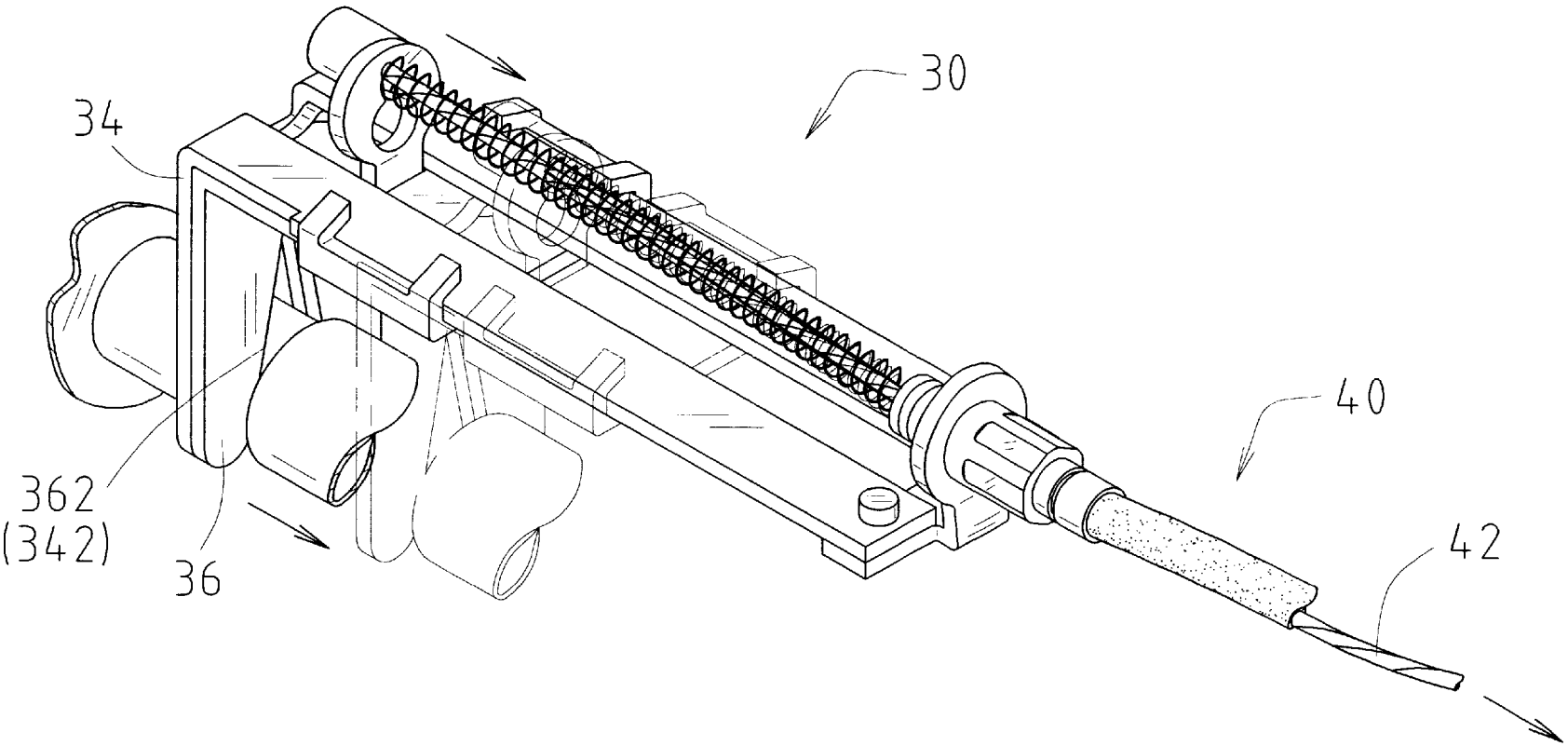
FIG. 7 is an operational view of the FIG. 6 clamping device.

Referring to FIGS. 6 and 7, there is shown a second embodiment of the invention wherein holding device 20 is replaced by a clamping device 30 connected to enlargement 45. As shown, clamping device 30 comprises a body 31 and a sliding member 32. A bent inwardly engagement member 322 is formed on respective one of four corners of one portion of sliding member 32. Body 31 is slidably sandwiched between engagement members 322 and sliding member 32. An abutment member 33 is formed on a side of body 31 while a first stop 34 is formed on the other opposite side of body 31. A threaded eye 332 is formed on abutment member 33 being threadedly secured to connector 41. A riser 35 is formed on sliding member 32 opposed to abutment member 33. Riser 35 comprises a hole 352 and a recess 354 in communication with the top of hole 352. The diameter of hole 352 is larger than that of enlargement 45. The width of recess 354 is smaller than the diameter of enlargement 45. As such, cable 42 may pass through recess 354. Enlargement 45 is secured to riser 35. Spring 43 is also secured to riser 35. As a result, user may manipulate connecting cable device 40 to control clamping device 30. A second stop 36 is formed on the side of sliding member 32 opposite to first stop 34. Stop 34 (or 36) has an inverted V-shaped recess 342 (or 362). As shown in FIG. 7, during use of clamping device 30, first grip the coupling of two pipes by stops 34, 36. Then, manipulate actuation device 10 to increase the distance between stops 34 and 36 for detaching coupling from pipes.

Figure 8:
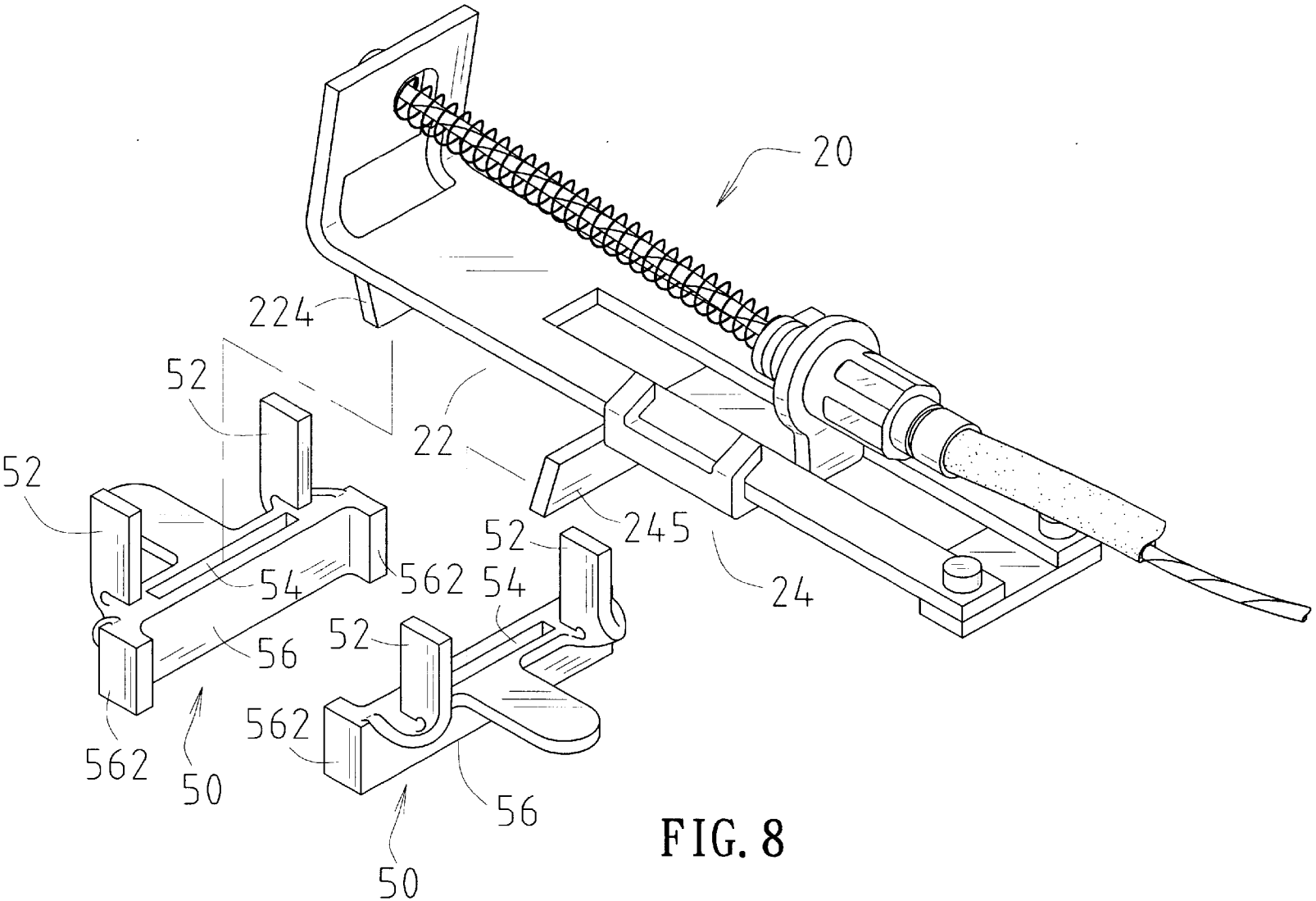
FIG. 8 is an exploded view of a holding device of a third preferred embodiment of extractor tool according to the present invention.

Referring to FIG. 8, there is shown a third embodiment of holding device wherein a pair of pressing elements 50 are additionally formed. Each pressing element 50 has two opposite uprights 52 for snapping body 22 therebetween. An elongate groove 54 is formed between uprights 52 for receiving either first pushing member 224 or second pushing member 245. A transverse member 56 is formed in the bottom for connecting uprights 52. A flange 562 is formed on either end of transverse member 56 for being readily adapted to the various couplings.

While the present invention has been described by means of specific embodiments, numerous modifications and variations could be made thereto by those skilled in the art without departing from the scope and spirit of the present invention set forth in the claims.

What is claimed is:

1. An extractor tool for pipe coupling for fastening a first pipe to a second pipe, the pipe coupling having a first and a second tab, the tool comprising:

an actuation device including a first handle having a first gripping portion at one end, a first attachment portion at the other end, and a first disk member between the first gripping portion and the first attachment portion, a second handle having a second gripping portion at one end, a second attachment portion at the other end, and a second disk member between the second gripping portion and the second attachment portion, a first pin pivotably secured the first and the second disk members together, an eye at the end of each of the first and the second attachment portions, a ratchet wheel on the arc of the first disk member, an abutment mechanism including an trigger member at one end and a pawl at the other end caught and held by the ratchet wheel for only allowing the first handle to move in one direction, a second pin inserted through the abutment mechanism and the first attachment portion, and a spring member between the second pin and the abutment mechanism for securing the second pin, the abutment mechanism, and first attachment portion together, thereby engaging the pawl with the ratchet wheel;

a holding device including a body having a wall in one end, an elongate recess open to the other end, a first opening at the wall, a second opening at the wall being larger than the first opening, and a channel communicating between the first and the second openings, a sliding member slidably provided thereon, a first pushing member projected downwardly from the body opposite to the wall, a recess, two opposite projections on the sides of the recess, an engagement member on either side of the sliding member, each projection being slidably sandwiched between the engagement member and the planar body of the sliding member, an upwardly projecting riser on one side of the sliding member opposite to the wall, and a downwardly projecting second pushing member under the sliding member opposite to the first pushing member, and a threaded hole on the riser; and a connecting cable device including a predetermined length of cable having an enlargement at one end smaller than both the threaded hole and the first opening and larger than the second opening so as to pass through the threaded hole and the first opening for engaging with the second opening and the other end slidably passed through the eye of the first attachment portion, a fastener for securing the cable to the eye of the second attachment portion, a spring put on the cable between the wall and the riser, whereby engage the holding device with the coupling, pivot the first attachment portion away from the second attachment portion for tautening the cable by pivoting the first disk member about the first pin to cause the ratchet wheel to turn relative to the pawl so as to pull the cable for adjusting the first and the second pushing members to cause them to tightly hold first and second tabs, pull the enlargement and the wall toward the riser for sliding the sliding member relative to the body for compressing the spring so as to reduce the distance between the first and the second pushing members which in turn enlarges the diameter of the coupling, thereby detaching the pipes.

2. The extractor tool according to the claim 1, wherein the trigger member is operable to lift a predetermined distance to disengage the pawl from the ratchet wheel after the coupling is detached from the pipes.

3. The extractor tool according to the claim 1, wherein the engagement member of the holding device comprises two spaced apart bent inwardly engagement sections.

4. The extractor tool according to the claim 1, further comprising a hollow connector put on the cable being secured to the riser.

5. The extractor tool according to the claim 1, further comprising a sleeving mechanism having a sleeve put on the cable and a clip for slidably securing the sleeve to the eye of the first attachment portion.

* * * * *